US008007086B2

(12) United States Patent
Aoki et al.

(10) Patent No.: US 8,007,086 B2
(45) Date of Patent: Aug. 30, 2011

(54) LIQUID CONTAINER

(75) Inventors: Yuji Aoki, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 906 days.

(21) Appl. No.: 11/962,158

(22) Filed: Dec. 21, 2007

(65) Prior Publication Data

US 2008/0151018 A1 Jun. 26, 2008

(30) Foreign Application Priority Data

Dec. 26, 2006 (JP) ..... 2006-350224

(51) Int. Cl.
*B41J 2/175* (2006.01)
*B41J 2/195* (2006.01)
*B41J 29/393* (2006.01)

(52) U.S. Cl. ..... 347/86; 347/7; 347/19

(58) Field of Classification Search ..... 347/7, 19, 347/49, 50, 58, 85, 86, 87
See application file for complete search history.

(56) References Cited

U.S. PATENT DOCUMENTS

| | | | | |
|---|---|---|---|---|
| 5,988,783 | A | 11/1999 | Tajika et al. | |
| 6,547,363 | B1 * | 4/2003 | Shinada et al. | 347/19 |
| 7,237,884 | B2 | 7/2007 | Sacco et al. | |
| 7,311,388 | B2 | 12/2007 | Ogura et al. | |
| 7,340,953 | B2 | 3/2008 | Green et al. | |
| 7,448,717 | B2 * | 11/2008 | Wanibe et al. | 347/19 |
| 7,510,251 | B2 | 3/2009 | Wanibe et al. | |
| 7,552,999 | B2 * | 6/2009 | Wanibe et al. | 347/50 |

(Continued)

FOREIGN PATENT DOCUMENTS

CN 1840346 A 10/2006

(Continued)

OTHER PUBLICATIONS

US Office Action issued in U.S. Appl. No. 11/960,064; dated Dec. 24, 2009.

(Continued)

*Primary Examiner* — Anh T. N. Vo
(74) *Attorney, Agent, or Firm* — Sughrue Mion, PLLC

(57) ABSTRACT

A liquid container includes: a container body which has a liquid containing portion for containing liquid therein and which is detachably mounted in a container mounting portion of a liquid consuming apparatus; a remaining liquid amount detecting unit in which a sensor member for detecting a state of a remaining liquid amount is provided in a unit case and which is detachably attached to the container body; a circuit board which has a memory device and a contact point for connecting the memory device to a connection terminal of the container mounting portion and which is attached to the container body; and a relay terminal which is attached to the unit case so as to electrically connect the sensor member to the circuit board. The remaining liquid amount detecting unit is attached to an attachment portion, which is provided at a position spaced apart from the circuit board on the container body, by a predetermined operation. The relay terminal is fixed to the unit case in a state where one end thereof comes in contact with and is electrically connected to a terminal of the sensor member, and the other end of the relay terminal is movably held on the unit case. A position regulating member for causing a position of the other end of the relay terminal to match a position of the contact point on the circuit board is provided near an attachment position of the circuit board so as to protrude from the attachment position.

15 Claims, 12 Drawing Sheets

U.S. PATENT DOCUMENTS

| | | | |
|---|---|---|---|
| 2006/0007259 | A1 | 1/2006 | Zhang |
| 2006/0250426 | A1 | 11/2006 | Wanibe et al. |
| 2007/0188529 | A1 | 8/2007 | Zhang |
| 2008/0136878 | A1 | 6/2008 | Nozawa et al. |
| 2008/0151017 | A1 | 6/2008 | Nozawa |
| 2008/0151018 | A1 | 6/2008 | Aoki et al. |
| 2008/0239038 | A1 | 10/2008 | Yoshimoto et al. |
| 2009/0262153 | A1 | 10/2009 | Tamaki et al. |

FOREIGN PATENT DOCUMENTS

| | | | |
|---|---|---|---|
| JP | 2001-328280 | A | 11/2001 |
| JP | 2003-011383 | A | 1/2003 |
| JP | 2007-152821 | A | 6/2007 |

OTHER PUBLICATIONS

US Office Action issued in U.S. Appl. No. 11/960,064; dated May 26, 2010.

International Search Report (PCT/ISA/210) for PCT/JP2007/07500, dated Apr. 22, 2008.

* cited by examiner

LIQUID CONTAINER

BACKGROUND

1. Technical Field

The present invention relates to a liquid container which supplies liquid to a liquid consuming apparatus, such as a liquid ejecting head, from which a small amount of liquid droplets are discharged.

2. Related Art

A liquid ejecting head of a textile printing apparatus, a microdispenser, or an ink jet type recording apparatus for commercial use which is used for extremely high-quality printing, is supplied with liquid, which is to be discharged therefrom, from a liquid container. In this case, if the liquid ejecting head operates in a state where liquid is not supplied thereto, so-called idling occurs to thereby damage the ejecting head. Accordingly, it is necessary to monitor the remaining liquid amount of a container in order to prevent the damage.

Therefore, in the case of the recording apparatus, there have been proposed various kinds of ink cartridges, which serve as liquid containers which contain ink therein, in which a remaining liquid amount detecting unit that detects the remaining liquid amount is provided.

Ink cartridges mounted in the recording apparatus can be broadly classified into an atmosphere open type ink cartridge and a sealed type ink cartridge.

In the atmosphere open type ink cartridge, an atmosphere open hole communicates with an ink containing portion partitioned within the cartridge. In this case, since outside air is introduced into the ink containing portion as ink contained in the ink containing portion is consumed, atmospheric pressure can be used for supply of the ink from the ink cartridge toward the recording apparatus. Accordingly, since the configuration of a container may be simplified, the atmosphere open type ink cartridge is suitable for an ink cartridge having a relatively small capacity.

On the other hand, in the sealed type ink cartridge, an ink containing portion is formed using a flexible bag having a sealed structure, for example, such that deterioration of ink caused by coming in contact with the air can be suppressed. In this case, since the quality of contained ink can be stably maintained for a long time, the sealed type ink cartridge is suitable for an ink cartridge having a large capacity. However, since it is necessary to provide a pressure means for pressing a flexible bag, which is an ink containing portion, from the outside, sizes of the cartridge and a recording apparatus are easily increased compared with the atmosphere open type ink cartridge.

For this reason, in such a case of providing a remaining liquid amount detecting unit in an ink cartridge, it is important to make attachment of the remaining liquid amount detecting unit to the a cartridge case (container body) easy in order to improve the productivity by simplifying a cartridge assembly process.

Previously, an ink cartridge in which an attaching hole passing through an ink containing portion is formed in a container body having the ink containing portion and a remaining liquid amount detecting unit is fitted in the attaching hole by screwing has been developed as the atmosphere open type ink cartridge.

In this case, the remaining liquid amount detecting unit is configured to include a cylindrical portion which is attached to the attaching hole by screwing, a locking piece which is provided to protrude from the outer periphery of the cylindrical portion outward in the radial direction and which is fixed to the container body by being engaged with a locking portion provided in the container body when the cylindrical portion is operated by screwing, and a piezoelectric device embedded in the cylindrical portion, and the piezoelectric device detects the amount of remaining ink within the ink containing portion on the basis of remaining vibration with respect to vibration that is oscillation within the ink containing portion (for example, Patent Document 1).

In this ink cartridge, the remaining liquid amount detecting unit may be attached to the container body only by screwing the remaining liquid amount detecting unit to the attaching hole formed in the container body. Accordingly, since a cartridge assembly process becomes simplified, the productivity may be improved.

Patent Document 1: JP-A-2001-328280

However, in the case of the sealed type ink cartridge, the screw-type remaining liquid amount detecting unit adopted in the above atmosphere open type ink cartridge cannot be applied.

In the case of the atmosphere open type ink cartridge, a vibration characteristic within an ink containing chamber noticeably changes with consumption of ink due to outside air which is introduced into the ink containing chamber according to the consumption of ink. Accordingly, with simple measurement of remaining vibration using a piezoelectric device, the amount of remaining ink can be quite correctly detected, and the piezoelectric device may also be miniaturized.

However, in the case of the sealed type ink cartridge, the outside air is not introduced into the ink containing chamber even if ink is consumed. Accordingly, with the simple measurement of remaining vibration adopted in the atmosphere open type ink cartridge, the amount of remaining ink cannot be detected with high precision.

For this reason, a remaining liquid amount detecting unit that measures pressure (flow rate) changing with the amount of remaining ink has been proposed. However, in this case, the remaining liquid amount detecting unit is configured to include a passage into which remaining ink flows, a sensor which detects fluctuation in the amount of ink flowing to the passage, and the like. As a result, the remaining liquid amount detecting unit becomes large sized.

For example, in an ink cartridge, a circuit board having a contact point electrically connected to a connection terminal of a recording apparatus is provided on an outer surface of a container body and an information readable and writable memory device is mounted on the circuit board such that the amount of remaining ink can be more precisely controlled or various kinds of information for preventing incorrect mounting can be read and written from the recording apparatus side.

In the ink cartridge provided with such circuit board, if a terminal of a sensor in a remaining liquid amount detecting unit is electrically connected to a contact point on the circuit board through a relay terminal provided on the remaining liquid amount detecting unit, the sensor can be controlled from the recording apparatus side and wiring lines to the sensor can be simplified.

However, as described above, since the remaining liquid amount detecting unit becomes large sized in the sealed type ink cartridge, a relay terminal on the remaining liquid amount detecting unit makes a large rotational movement when the remaining liquid amount detecting unit is attached to the container body by rotation. At that time, positional deviation between a contact point on the circuit board and an end of the relay terminal may occur due to, for example, an attachment error caused by a dimensional tolerance, and as a result, there is a possibility that a trouble, such as poor contact, will occur.

For this reason, in the case of the sealed type ink cartridge, attachment based on a simple rotation operation cannot be adopted in an attachment structure of the remaining liquid amount detecting unit, and it takes time and effort to attach the remaining liquid amount detecting unit. As a result, a problem that an improvement in productivity is difficult occurs.

SUMMARY

An advantage of some aspects of one embodiment of the invention is to provide a liquid container capable of easily attaching a remaining liquid amount detecting unit to a container body and causing a contact point on a circuit board provided in the container body to be reliably electrically connected to a terminal of a sensor on the remaining liquid amount detecting unit through a relay terminal of the remaining liquid amount detecting unit when applied to a sealed type ink cartridge, for example. The advantage can be attained by at least one aspect of the following aspects:

A first aspect of the invention provides a liquid container including: a container body which has a liquid containing portion for containing liquid therein and which is detachably mounted in a container mounting portion of a liquid consuming apparatus; a remaining liquid amount detecting unit in which a sensor member for detecting a state of a remaining liquid amount is provided in a unit case and which is detachably attached to the container body; a circuit board which has a memory device and a contact point for connecting the memory device to a connection terminal of the container mounting portion and which is attached to the container body; and a relay terminal which is attached to the unit case so as to electrically connect the sensor member to the circuit board, wherein the remaining liquid amount detecting unit is attached to an attachment portion, which is provided at a position spaced apart from the circuit board on the container body, by a predetermined operation, the relay terminal is fixed to the unit case in a state where one end thereof comes in contact with and is electrically connected to a terminal of the sensor member, and the other end of the relay terminal is movably held on the unit case, and a position regulating member for causing a position of the other end of the relay terminal to match a position of the contact point on the circuit board is provided near an attachment position of the circuit board so as to protrude from the attachment position.

According to the configuration described above, since attachment of the remaining liquid amount detecting unit to the container body having the liquid containing portion is completed by a predetermined operation, assembly efficiency is satisfactory. For example, in the case where the above configuration is applied to a sealed type ink cartridge, it is possible to improve the productivity of an ink cartridge by the improvement in assembly efficiency.

In addition, since the one end of the relay terminal, which electrically connects the terminal of the sensor member provided on the remaining liquid amount detecting unit to detect a state of the amount of remaining liquid to the contact point on the circuit board, is positioned and fixed to the unit case of the remaining liquid amount detecting unit in a state where the one end comes in contact with and is electrically connected to the terminal of the sensor member that detects the state of the amount of remaining liquid, the relay terminal is reliably connected to the terminal of the sensor member.

Furthermore, the other end of the relay terminal, which is movably supported on the unit case, matches the position of the contact point on the circuit board by means of the position regulating member provided in the container body to which the circuit board is fixed. Accordingly, the other end of the relay terminal is also reliably connected to the contact point of the circuit board regardless of a dimensional tolerance or an assembly error.

Thus, it is possible to make the contact point on the circuit board provided on the container body reliably electrically connected to the terminal of the sensor on the remaining liquid amount detecting unit through the relay terminal of the remaining amount detecting unit attached to the container body.

Furthermore, according to a second aspect of the invention, in the liquid container according to the first aspect of the invention, preferably, attachment of the remaining liquid amount detecting unit to the attachment portion is completed by the predetermined operation of fitting the remaining liquid amount detecting unit to the attachment portion on the container body and then rotating the remaining liquid amount detecting unit, and the other end of the relay terminal is held on the unit case so as to be movable in a rotation-axis direction when the remaining liquid amount detecting unit is attached to the container body.

In such a configuration, attachment of the remaining liquid amount detecting unit to the container body is completed, in such a manner that the remaining liquid amount detecting unit is fixed to the container body only by a simple operation of fitting the remaining liquid amount detecting unit to the attachment portion, which is positioned apart from the circuit board on the container body, and then rotating the remaining liquid amount detecting unit around the attachment portion. Thus, the improvement in assembly efficiency described in the first aspect can be achieved.

Furthermore, according to a third aspect of the invention, in the liquid container according to the second aspect of the invention, preferably, an elastic member for enabling elastic displacement to a side of a rotation axis of when the remaining liquid amount detecting unit is attached to the container body is provided on the other end of the relay terminal that is brought into contact with the contact point on the circuit board.

In such a configuration, positional deviation of the other end of the relay terminal caused by the dimensional tolerance or the assembly error is absorbed by the elastic displacement of the elastic member provided on the other end of the relay terminal, and a variation in contact pressure between the other end of the relay terminal and the contact point on the circuit board is suppressed. As a result, highly reliable electrical connection can be realized.

Furthermore, according to a fourth aspect of the invention, in the liquid container according to the third aspect of the invention, preferably, the elastic member provided on the other end of the relay terminal is a bent portion.

In such a configuration, the elastic member of the other end may be formed only by a predetermined bending process, for example, in the case where the relay terminal is formed by press molding using a metal plate. In addition, the elastic member may be provided on the other end without consumption of time and effort taken for addition, connection, and the like of a separate component.

Furthermore, according to a fifth aspect of the invention, in the liquid container according to any one of the first to fourth aspects of the invention, preferably, a deep-drawing portion that increases a rigidity of the terminal is formed along a longitudinal direction of the terminal near an attaching hole of the one end of the relay terminal that is fixed to the unit case.

In such a configuration, since the rigidity of the relay terminal is increased due to the deep-drawing portion formed near the attaching hole, it is possible to prevent the relay terminal from deforming due to a load when fitting the attaching hole of the relay terminal in a boss on the unit case by pressure. In addition, it is possible to prevent the positioning accuracy of the ends of the relay terminal from decreasing due to deformation caused by the load at the time of attachment.

Furthermore, according to a sixth aspect of the invention, in the liquid container according to any one of the first to fifth aspects of the invention, preferably, the relay terminal has at least one elastic deformation allowing portion in a middle part thereof located between the one end and the other end.

In such a configuration, the positional deviation caused by the dimensional tolerance or the assembly error can be absorbed not only by the elastic member provided on the other end of the relay terminal but also by the elastic deformation allowing portion provided in the middle part. As a result, the reliability of electrical connection made between the sensor member and the circuit board through the relay terminal can be further improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid container according to an exemplary embodiment of the invention will be described in detail with reference to the accompanying drawings.

Figure 1:
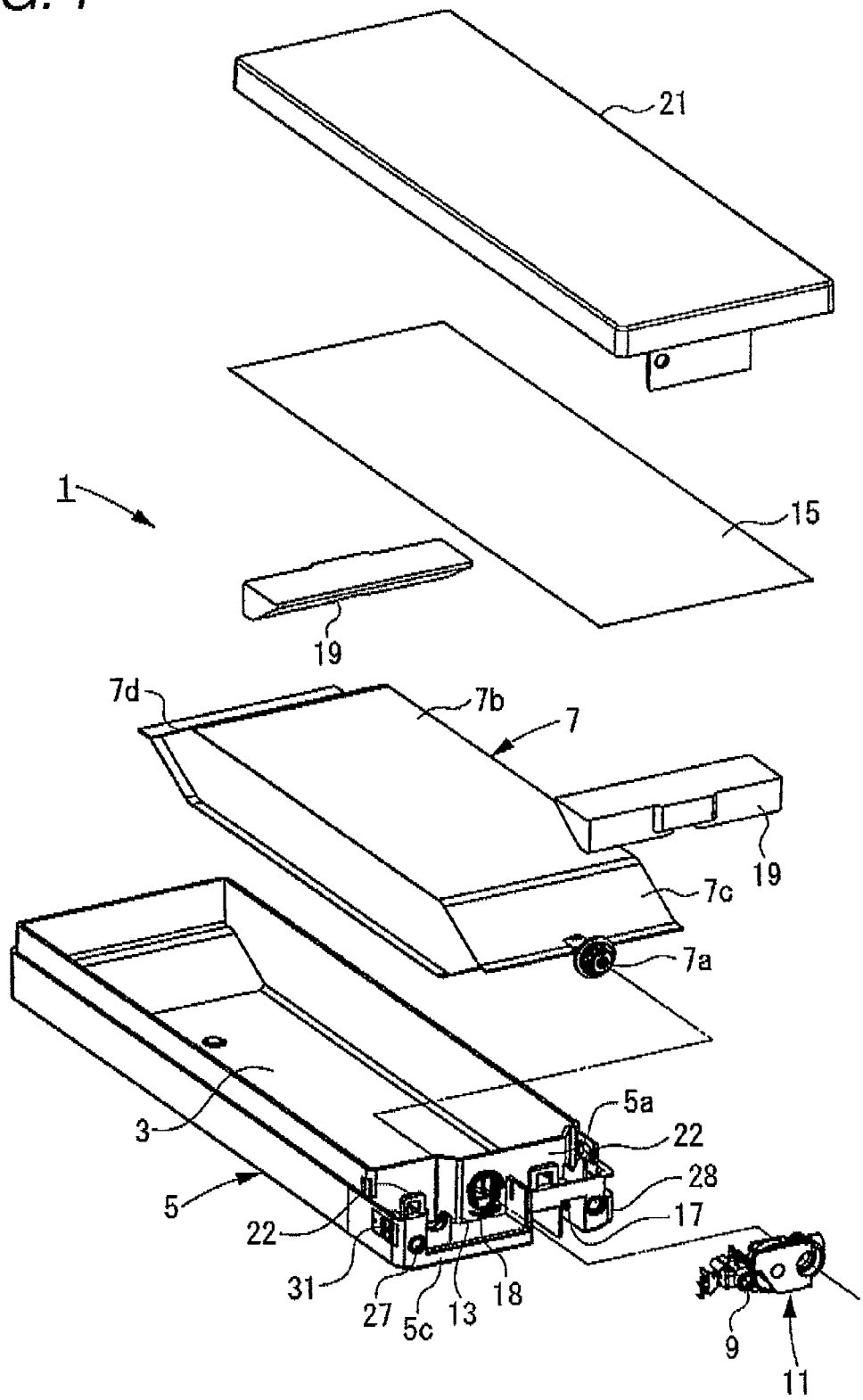
FIG. 1 is an exploded perspective view illustrating an ink cartridge as an embodiment.
Figure 2:
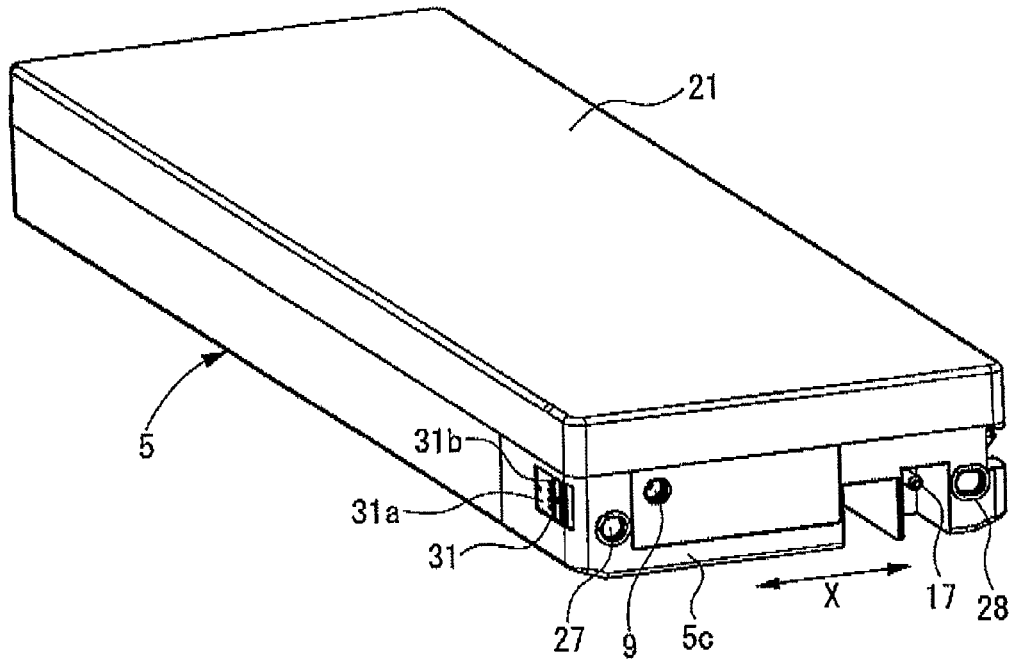
FIG. 2 is a perspective view illustrating an assembled state of the ink cartridge.
Figure 3:
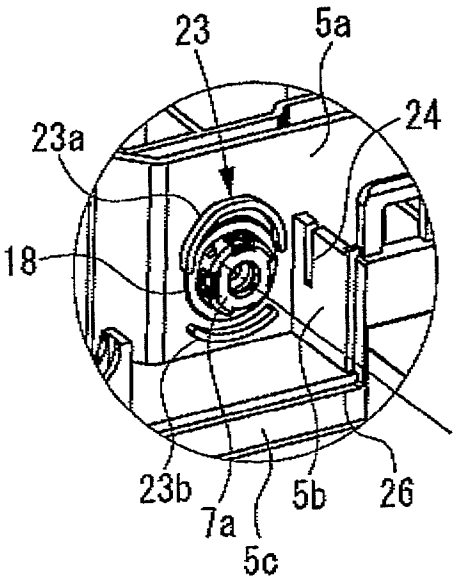
FIG. 3A is a perspective view illustrating a state where an ink pack is mounted in a pack accommodating section.
FIG. 3B is an enlarged view illustrating an A portion of FIG. 3A.
Figure 3:
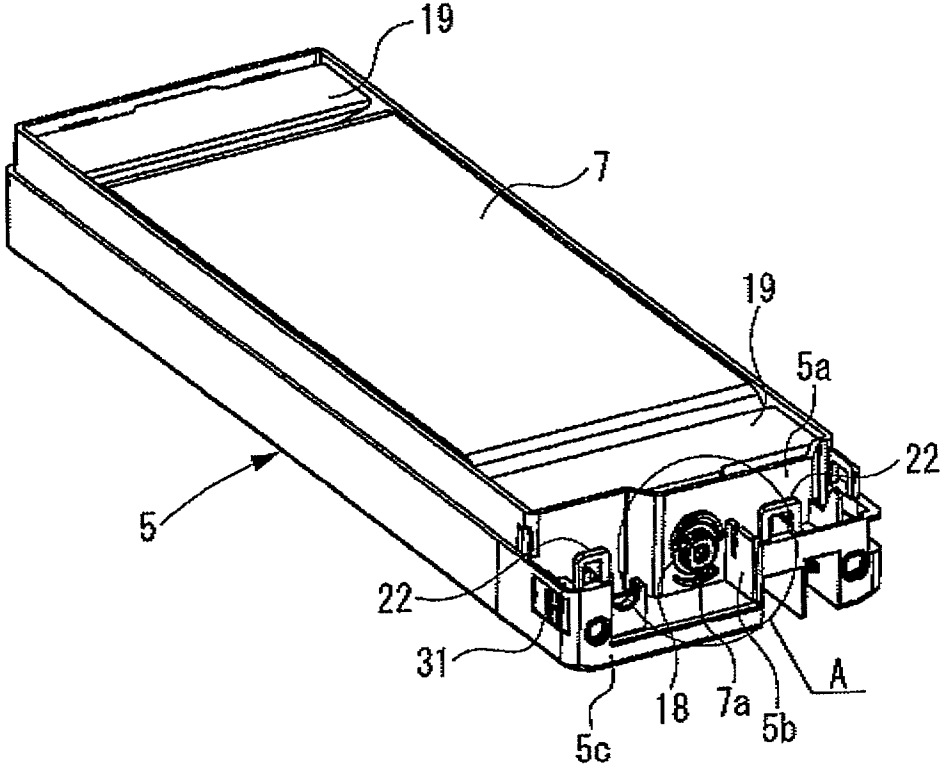
Figure 4:
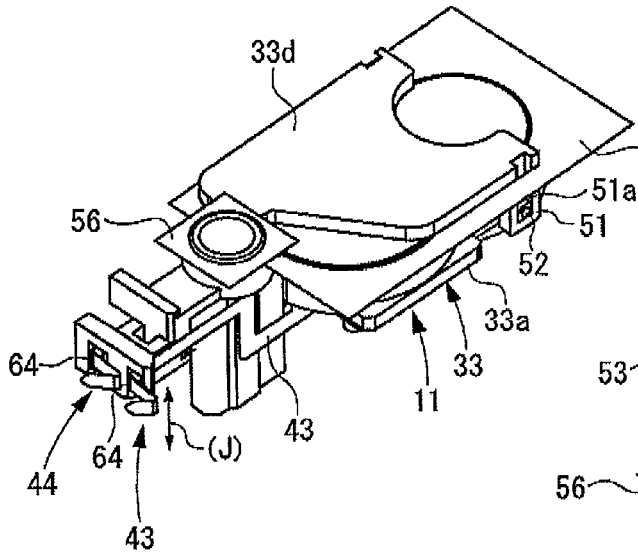
FIG. 4A is a perspective view illustrating a remaining liquid amount detecting unit as viewed from a front surface side.
FIG. 4B is an exploded perspective view illustrating the remaining liquid amount detecting unit.
Figure 4:
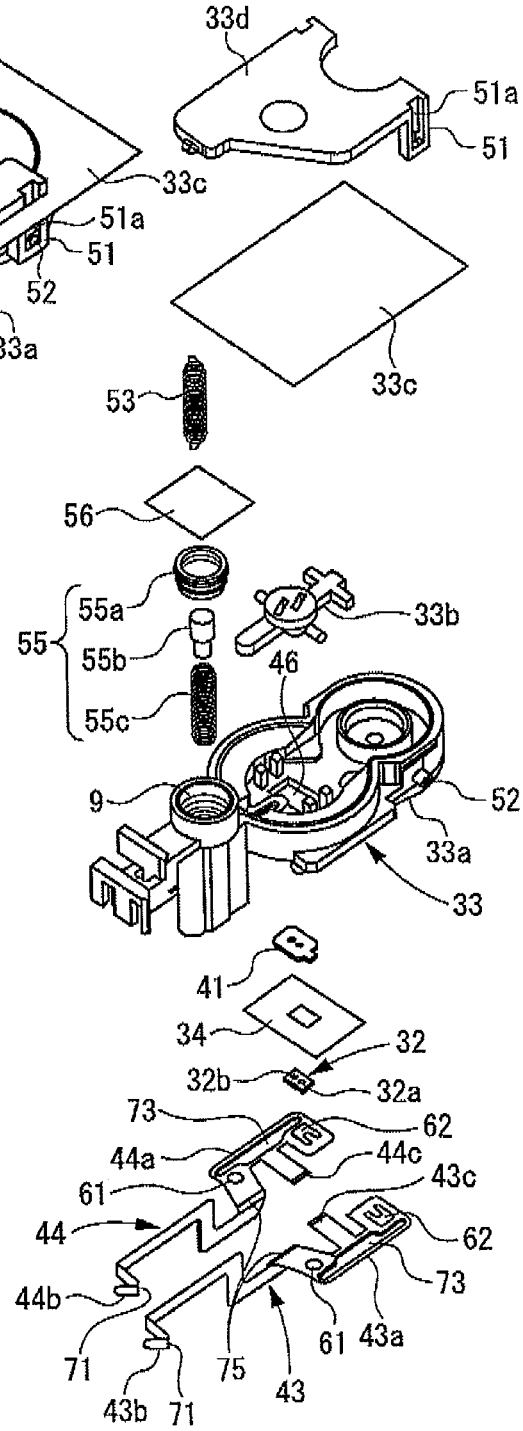

FIG. 1 is an exploded perspective view illustrating an ink cartridge as a liquid container according to an embodiment of the invention, and FIG. 2 is a perspective view illustrating an assembled state of the ink cartridge shown in FIG. 1. FIG. 3A is a perspective view illustrating a state where an ink pack, which is a liquid containing portion, and a spacer, which fills up a gap around the ink pack, are mounted in a pack accommodating section of a container body shown in FIG. 1, and FIG. 3B is an enlarged view illustrating an A portion of FIG. 3A. FIG. 4A is a perspective view illustrating a remaining liquid amount detecting unit shown in FIG. 1 as viewed from a front surface side, and FIG. 4B is an exploded perspective view illustrating the remaining liquid amount detecting unit.

Figure 5:
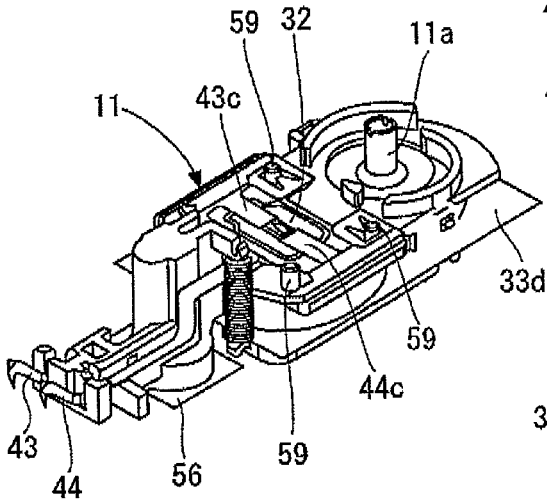
FIG. 5A is a perspective view illustrating a remaining liquid amount detecting unit as viewed from a bottom surface side.
FIG. 5B is an exploded perspective view illustrating the remaining liquid amount detecting unit.
Figure 5:
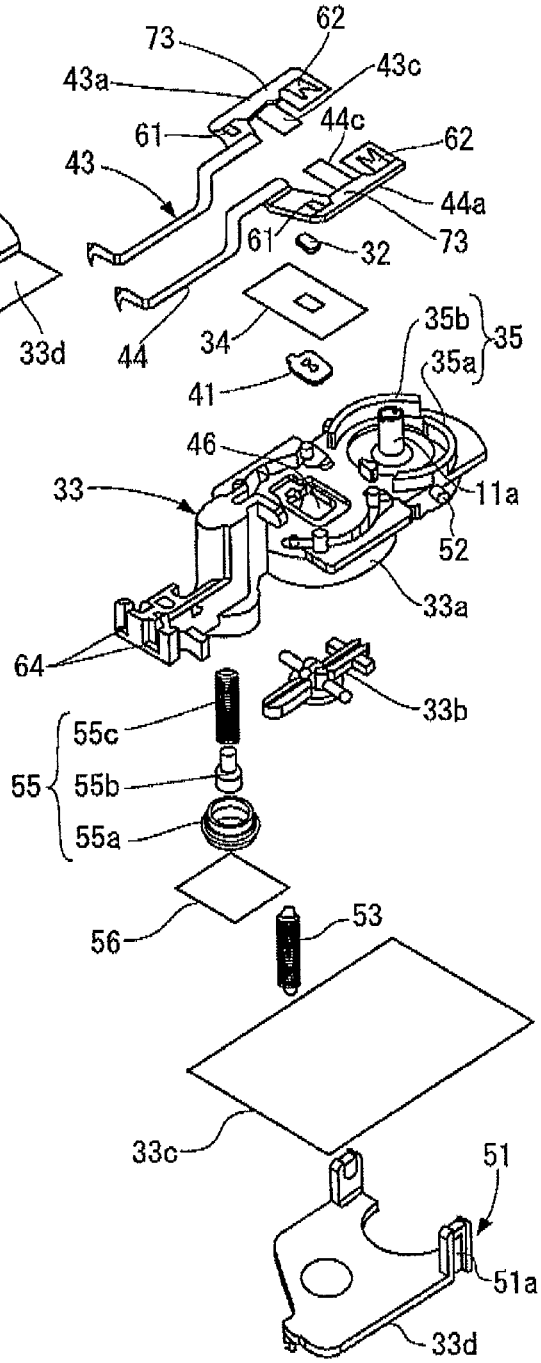
Figure 6:
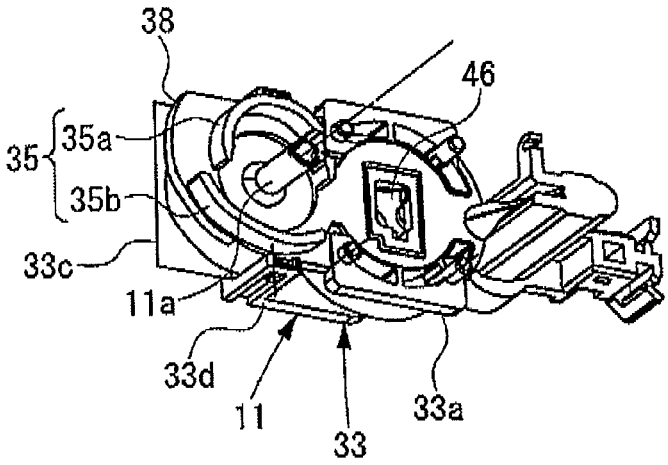
FIG. 6 is a perspective view illustrating the remaining liquid amount detecting unit as viewed from another direction.

In addition, FIG. 5A is a perspective view illustrating the remaining liquid amount detecting unit as viewed from a bottom surface side, and FIG. 5B is an exploded perspective view illustrating the remaining liquid amount detecting unit. FIG. 6 is a perspective view illustrating the remaining liquid amount detecting unit shown in FIG. 5A as viewed from another direction.

An ink cartridge 1 shown in FIGS. 1 and 2 is detachably mounted in a cartridge mounting portion of an ink j et type recording apparatus for commercial use and supplies ink to a recording head (liquid ejecting head) provided in the recording apparatus.

The ink cartridge 1 includes: a container body 5 in which a pack accommodating section 3 pressed by a pressure means is separately formed; an ink pack 7 serving as a liquid containing portion which stores ink therein, is accommodated in the pack accommodating section 3, and discharges stored ink from a connection port 7*a* by pressure of the pack accommodating section 3; and a retaining liquid amount detecting unit 11 which has a liquid lead-out portion 9 serving to supply ink to a recording head, which is an external liquid consuming apparatus, and is detachably mounted in the container body 5.

The container body 5 is a housing formed by resin molding. In the container body 5, the approximately box-shaped pack accommodating section 3 whose upper part is open and a detection unit accommodating section 13, which is located on a front surface side of the pack accommodating section 3 and accommodates the remaining liquid amount detecting unit 11 therein, are formed so as to be separated from each other.

An open surface of the pack accommodating section 3 is sealed with a sealing film 15 after the ink pack 7 is accommodated in the pack accommodating section 3. Thus, the pack accommodating section 3 becomes a sealed chamber.

A pressure port 17 serving as a communicating path used to apply pressure air inside the pack accommodating section 3, which is formed as a sealed chamber by the sealing film 15, is provided in a partition wall 5*a* which separates the pack accommodating section 3 from the detection unit accommodating section 13. When the ink cartridge 1 is mounted in a cartridge mounting portion of an ink jet type recording apparatus, a pressure air supplying section on a side of the cartridge mounting portion is connected to the pressure port 17. Accordingly, it becomes possible to press the ink pack 7 with pressure air supplied to the inside of the pack accommodating section 3.

The ink pack 7 is obtained by bonding the cylindrical connection port 7*a*, to which a connection pin 11*a* (refer to FIG. 6) of the remaining liquid amount detecting unit 11 is inserted and connected, to one end of a flexible bag 7*b* formed of an aluminum-laminated double-layered film which is obtained by laminating an aluminum layer on a resin film layer. A high gas barrier property is secured by using the aluminum-laminated double-layered film.

The connection port 7*a* of the ink pack 7 is airtight inserted through an opening 18 for insertion of a connection port, which is formed on the partition wall 5*a*, such that a front end thereof protrudes inside the detection unit accommodating section 13 as shown in FIGS. 3A and 3B.

The ink pack 7 is filled beforehand with ink adjusted to a state having a high degree of degassing before connecting the remaining liquid amount detecting unit 11 thereto.

When the ink pack 7 is mounted in the pack accommodating section 3, spacers 19 formed of a resin are mounted on inclined portions 7*c* and 7*d* positioned at front and rear sides of the flexible bag 7*b*. The spacers 19 formed of a resin prevent the ink pack 7 from wobbling within a sealed chamber when a top surface of the pack accommodating section 3 is covered with the sealing film 15 such that the pack accommodating section 3 becomes the sealed chamber, and at the same time, improves pressure efficiency when pressing the inside of the pack accommodating section 3 with pressure air by filling up a superfluous empty space within the sealed chamber.

A cover 21 formed of a resin is mounted on the sealing film 15 that seals an open surface of the detection unit accommodating section 13 including the pack accommodating section 3. When the cover 21 is put on the container body 5, an engaging means 22 (not shown) is engaged with an engaging portion on a side of the container body 5. As a result, the cover 21 is fixed to the container body 5.

An attachment portion 23 to which the remaining liquid amount detecting unit 11 is attached by a predetermined operation is provided around the opening 18 that is opened to the partition wall 5*a*, as shown in FIG. 3B.

In the present embodiment, the predetermined operation refers to performing a fitting operation and then performing a rotation operation, which will be described in detail later.

In the present embodiment, the attachment portion 23 has a fitting structure where the remaining liquid amount detecting unit 11 is rotatably fitted and mounted and is provided at the position spaced apart from a circuit board 31, which will be described later, on the container body 5. Specifically, the attachment portion 23 includes two curved protruding walls 23*a* and 23*b*, and these curved protruding walls 23*a* and 23*b* form a ring structure for regulating rotation of the remaining liquid amount detecting unit 11.

In addition, at the position close to the attachment portion 23, a locking groove 24 which prevents dropping of the remaining liquid amount detecting unit 11 fitting in the attachment portion 23 is provided in a partition wall 5*b* which is provided in the detection unit accommodating section 13 so as to be perpendicular to the partition wall 5*a*, as shown in FIG. 3B.

In a front wall 5*c* of the container body 5 serving as a partition wall which covers a front surface side of the detection unit accommodating section 13, an opening 26 obtained by notching at the position facing the attachment portion 23 is formed for the purpose of an operation of attaching the remaining liquid amount detecting unit 11.

On both side portions of the front wall 5*c*, positioning holes 27 and 28 into which positioning pins provided in the cartridge mounting portion are inserted when mounting the ink cartridge 1 in the cartridge mounting portion are provided, as shown in FIG. 2.

One positioning hole 27 is set as a circular hole, and the other positioning holes 28 is set as a long hole which is long in the width direction (direction indicated by arrow X of FIG. 2) of the container body 5. Thus, by forming one positioning hole 28 as a long hole, allowance of dimensional tolerance and the like becomes easy while maintaining the positioning accuracy.

At the position, which is close to the front surface, on the side wall of the container body 5 near the positioning hole 27 that is a circular hole, there is provided the circuit board 31 which comes in contact with a connection terminal provided in the cartridge mounting portion when mounting the ink cartridge 1 in the cartridge mounting portion to thereby realize electrical connection.

As shown in FIG. 2, the circuit board 31 has a plurality of contact points 31*b*, which are in contact with connection terminals provided in the cartridge mounting portion, formed on a front surface 31*a* thereof.

Figure 9:
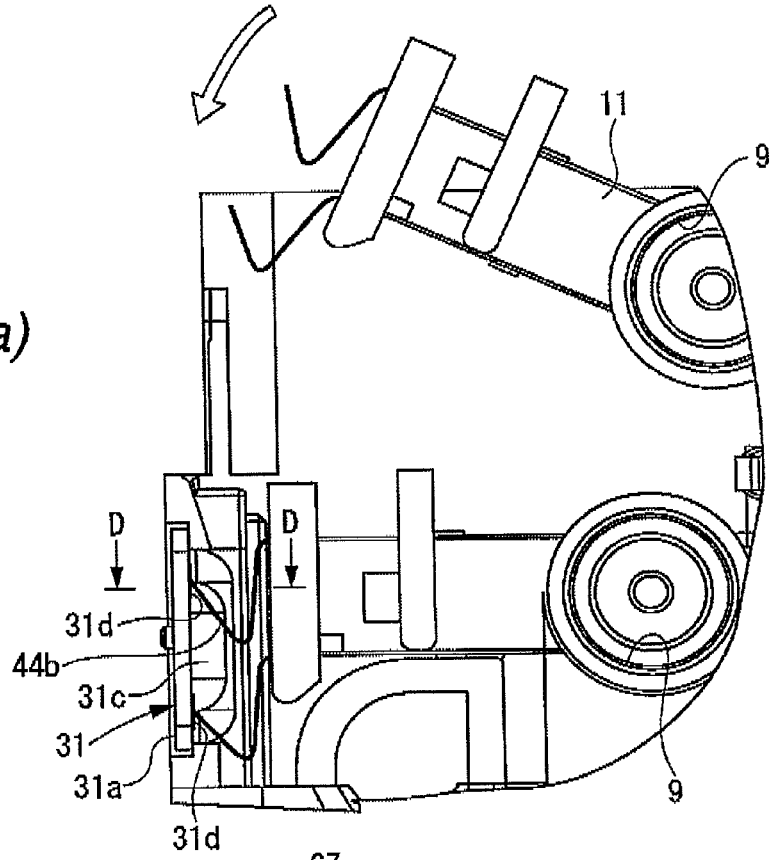
FIG. 9A is an enlarged view illustrating a C portion of FIG. 8.
FIG. 9B is a cross-sectional view taken along the line D-D of FIG. 9A.
Figure 9:
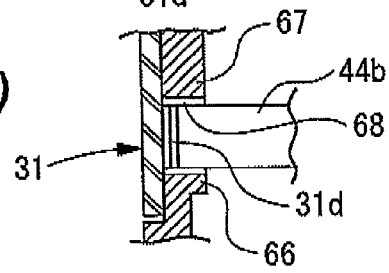

In addition, as shown in FIGS. 9A and 9B, a memory device 31*c* for recording information, such as the amount of remaining ink, cartridge use history, and the like, is mounted on a back surface of the circuit board 31 and a contact point 31*d* used to electrically connect a sensor member (including a piezoelectric element; hereinafter, simply referred to as a 'sensor member') 32, which is mounted in the remaining liquid amount detecting unit 11 and detects a remaining liquid state, to a connection terminal of an ink jet type recording apparatus is also formed on the back surface of the circuit board 31. Therefore, when the ink cartridge 1 is mounted in the cartridge mounting portion such that each contact point 31*b* on the surface of the circuit board 31 is connected to the connection terminal of the cartridge mounting portion, the memory device 31*c* and the sensor member 32 are electrically connected to a control circuit of the recording apparatus through the circuit board 31 and it becomes possible to control operations of the memory device 31*c* and the sensor member 32 from the recording apparatus side.

In the present embodiment, the remaining liquid amount detecting unit 11 includes: a unit case 33 which is attached to the container body 5 by a rotation operation and is formed of a resin; a sensor member 32 that is fixed to a bottom surface side of the unit case 33 through a sensor base 41 interposed therebetween; an insulating sensor film 34 which covers a surface of the sensor base 41 around the sensor member 32; and a pair of relay terminals 43 and 44 which are formed of metal and are attached to the unit case 33 from the above of the sensor film 34 so as to connect terminals 32*a* and 32*b* on the sensor member 32 to the contact point 31*d* on the bottom surface of the circuit board 31, as shown in FIGS. 4A to 6.

The unit case 33 is configured to include: a case body 33*a* having a liquid lead-out section 9, to which an ink supply pin on a side of the cartridge mounting portion is inserted and connected, and an internal passage space 46 communicating with the liquid lead-out section 9; a passage forming member 33*b* which is provided within the internal passage space 46 and forms a passage communicating with the liquid lead-out section 9 in cooperation with the internal passage space 46; a pressure chamber film 33*c* which is welded to an end surface of the case body 33*a* and seals an open surface of the internal passage space 46 to thereby partition a pressure chamber for remaining amount detection; and a lid 33*d* which covers and protect the pressure chamber film 33*c*.

The lid 33*d* is rotatably connected to the case body 33*a* by fitting an engagement shaft 52, which protrudes toward the outer periphery of the case body 33*a*, in a hole 51*a* of a locking piece 51 protruding toward a base end. In addition, the lid 33*d* is fixed to the case body 33*a* by connecting a front end to the case body 33*a* using a spring 53.

A passage opening and closing mechanism 55, which causes a passage to be opened when an ink supply pin on a side of the cartridge mounting portion is inserted, is mounted in the liquid lead-out section 9. The passage opening and closing mechanism 55 is configured to include a cylindrical valve seat member 55*a* fixed to the liquid lead-out portion 9, a valve body 55*b* which is put into the valve seat member 55*a* to thereby maintain the passage in a closed state, and a spring member 55*c* which biases the valve body 55*b* in the direction where the valve body 55*b* is put into the valve seat member 55*a*. An opening end of the liquid lead-out portion 9 in which the passage opening and closing mechanism 55 is mounted is sealed with a supply port film 56.

When the ink cartridge 1 is mounted in a cartridge mounting portion of a recording apparatus, an ink supply pin provided in the cartridge mounting portion breaks through the supply port film 56 to be inserted into the liquid lead-out portion 9. At this time, since the ink supply pin inserted in the liquid lead-out portion 9 causes the valve body 55*b* to escape from the valve seat member 55*a*, the passage within the unit case 33 can communicate with the ink supply pin. As a result, supply of ink to the recording apparatus becomes possible.

The case body 33*a* has a container fitting portion 35, which rotatably fits in the attachment portion 23, at the position corresponding to the attachment portion 23 of the container body 5 on a bottom surface thereof. A connection pin 11*a* which is inserted and connected to the connection port 7*a* of the ink pack 7 is provided inside the container fitting portion 35. A passage in which the internal passage space 46 and the passage forming member 33*b* are formed is an internal passage through which the liquid lead-out portion 9 and the connection pin 11*a* communicate with each other.

The sensor member 32 is a piezoelectric sensor, which is fixed to a bottom surface side of the case body 33*a* such that vibration can be applied to an inside passage, and outputs as an electrical signal a change of residual vibration occurring according to a change of an ink flow rate (pressure) within the inside passage. A control circuit of a recording apparatus side analyzes the output signal of the sensor member 32, and thus the amount of remaining ink in the ink pack 7 is detected.

In the present embodiment, as shown in FIG. 6, the container fitting portion 35 includes two curved protruding walls 35*a* and 35*b*, which rotatably fit to the protruding walls 23*a* and 23*b* of the attachment portion 23, and these curved protruding walls 35*a* and 35*b* form a ring structure for regulating rotation of the remaining liquid amount detecting unit 11.

Figure 7:
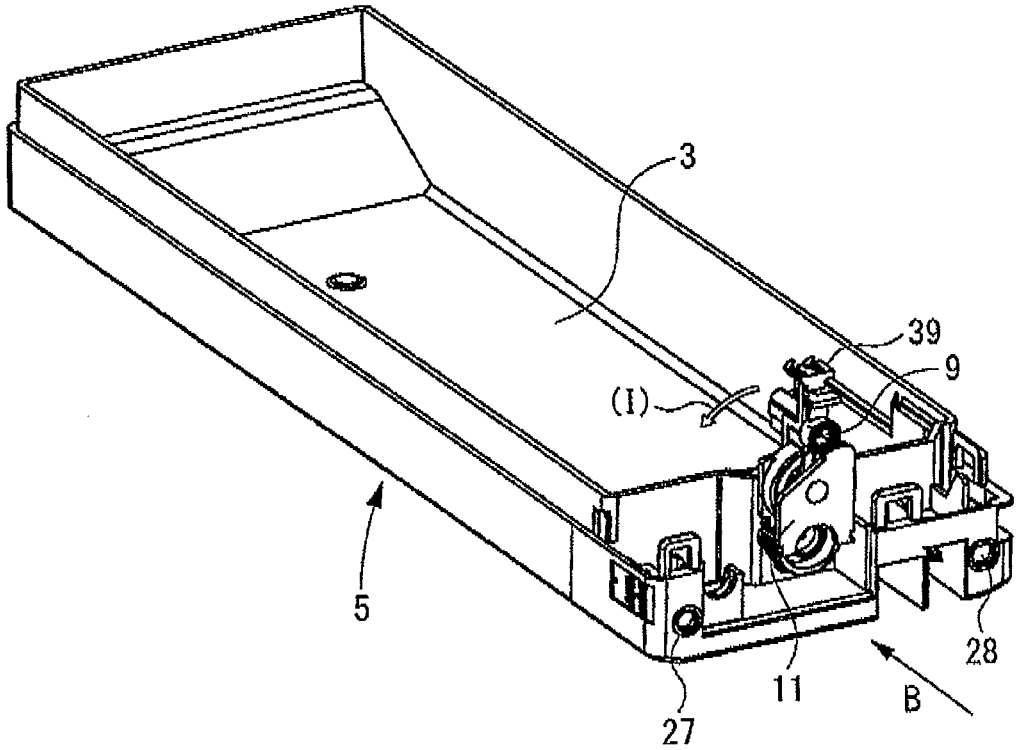
FIG. 7 is a perspective view illustrating a state where a remaining liquid amount detecting unit is fitted to be mounted.
Figure 8:
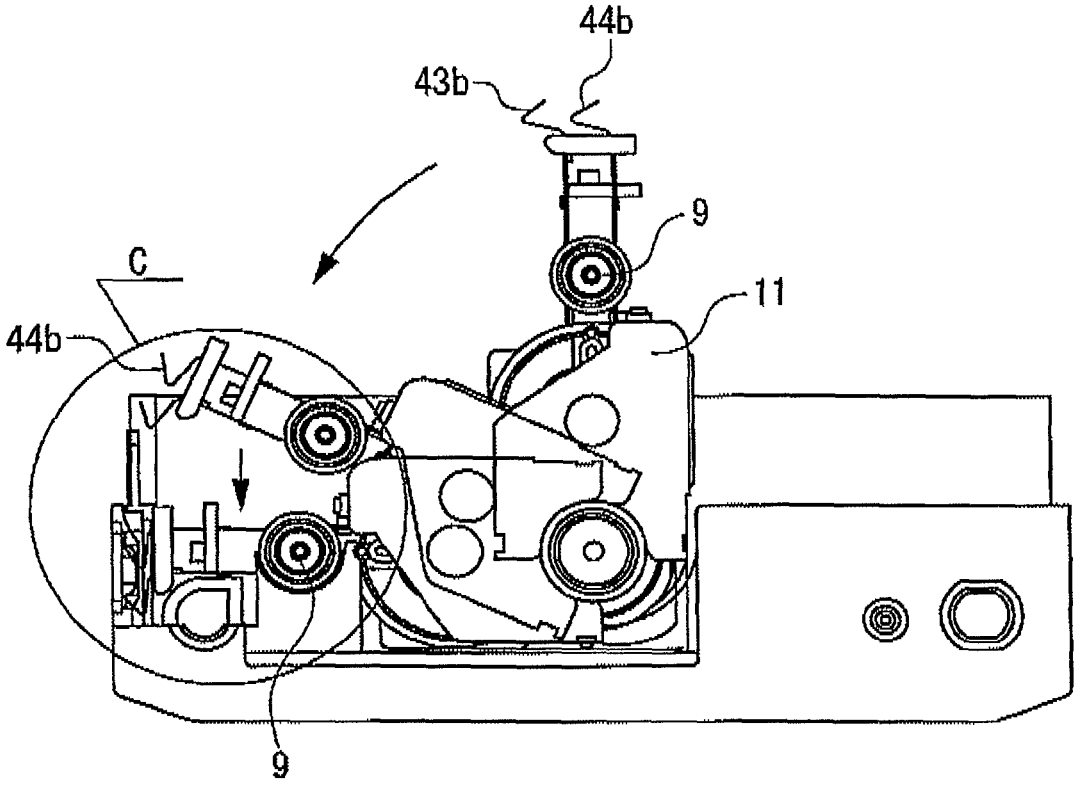
FIG. 8 is a view from a direction indicated by arrow B of FIG. 7.
Figure 12:
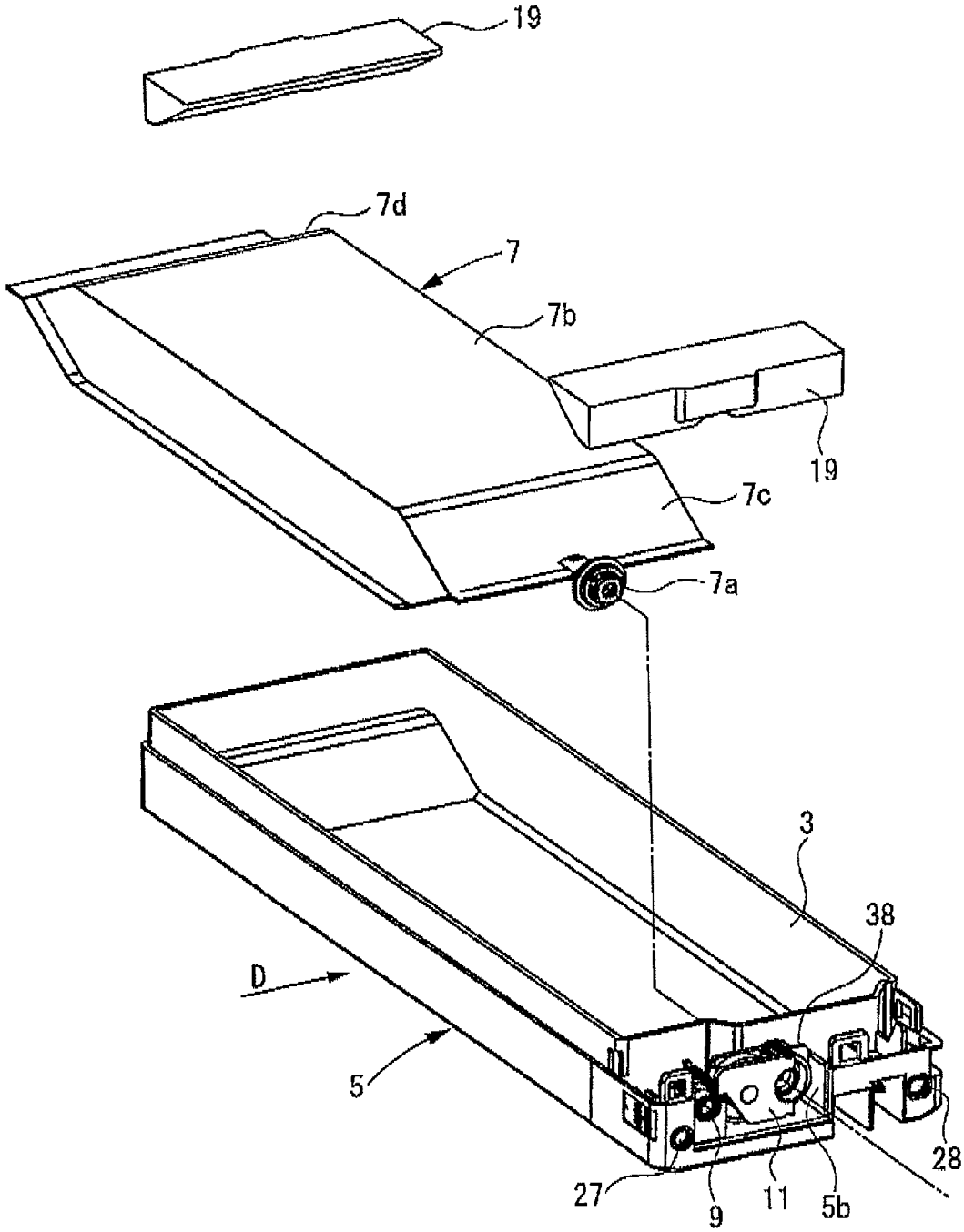
FIG. 12 is a perspective view illustrating a process of assembling an ink pack in a pack accommodating section.
Figure 13:
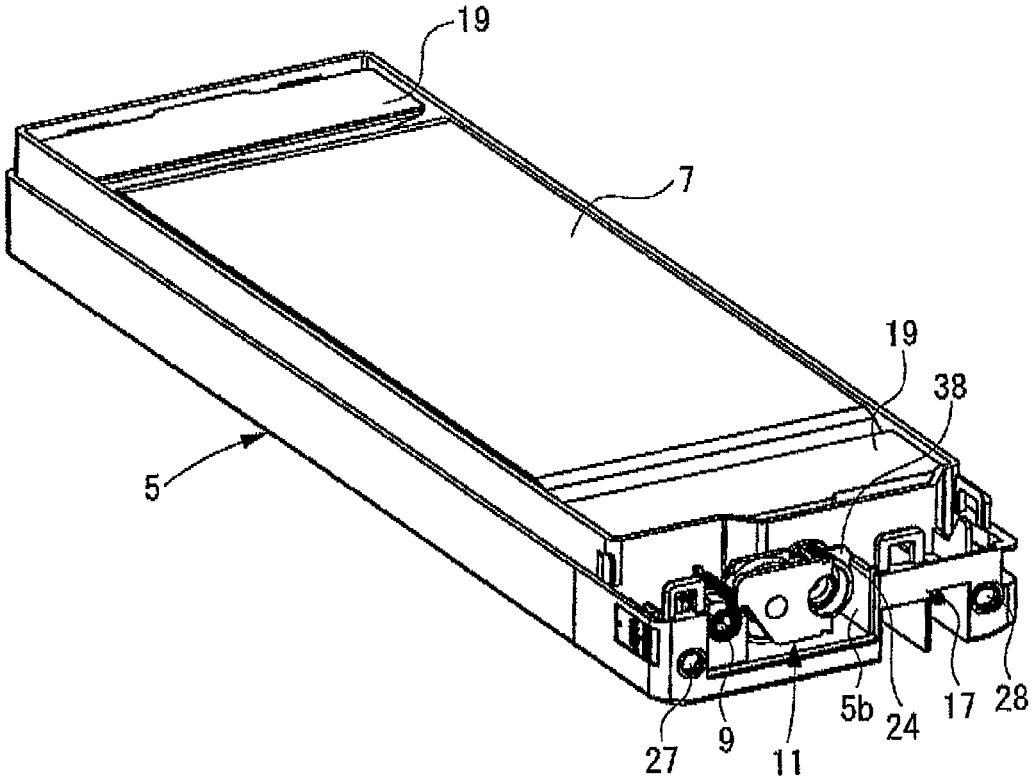
FIG. 13 is a perspective view illustrating a state where an assembly process is completed.

A locking piece 38 is provided around the container fitting portion 35 on the case body 33*a*. The locking piece 38 is engaged with the locking groove 24 (refer to FIG. 3B) on a side of the container body 5 as shown in FIGS. 12 and 13 when the remaining liquid amount detecting unit 11 is rotated in a direction indicated by arrow I from a state where the container fitting portion 35 fits to the attachment portion 23 as shown in FIG. 7, thereby preventing dropping of the fitting portion.

The relay terminals 43 and 44 attached to the unit case 33 are attached to the case body 33*a* of the unit case 33 such that one ends 43*a* and 44*a* thereof come in contact with the terminals 32*a* and 32*b* of the sensor member 32 attached to the unit case 33 and the other ends 43*b* and 44*b* come in contact with the contact point 31*d* on the circuit board 31, thereby causing the sensor member 32 to be electrically connected to the circuit board 31.

More specifically, the relay terminals 43 and 44 are fixed to the case body 33*a* of the unit case 33 in a state where the one ends 43*a* and 44*a* thereof come in contact with the terminals 32*a* and 32*b* of the sensor member 32 so as to be electrically connected to the terminals 32*a* and 32*b* of the sensor member 32. In addition, the other ends 43*b* and 44*b* of the relay terminals 43 and 44 are held on the unit case 33 so as to be movable in a rotation-axis direction (direction indicated by arrow J of FIG. 4A) when the remaining liquid a mount detecting unit 11 is attached to the container body 5.

Specifically, in the one ends 43*a* and 44*a* of the relay terminals 43 and 44, contact pieces 43*c* and 44*c* which are brought into contact with the terminals 32*a* and 32*b* are integrally formed and attaching holes 61 and 62, in which bosses 59 (refer to FIG. 5A) provided in the case body 33*a* so as to protrude therefrom fit by pressing, are provided, respectively. The one ends 43*a* and 44*a* of the relay terminals 43 and 44 are fixed to the case body 33*a* by the pressure fitting.

The positions of the other ends 43*b* and 44*b* of the relay terminals 43 and 44 are regulated by slits 64, which are formed in an end of the case body 33*a*, along the rotation-axis direction (direction indicated by arrow J of FIG. 4A) when the remaining liquid amount detecting unit 11 is attached to the container body 5. Accordingly, the other ends 43*b* and 44*b* of the relay terminals 43 and 44 are held so as to be movable in the direction indicated by arrow J of FIG. 4A.

Figure 11:
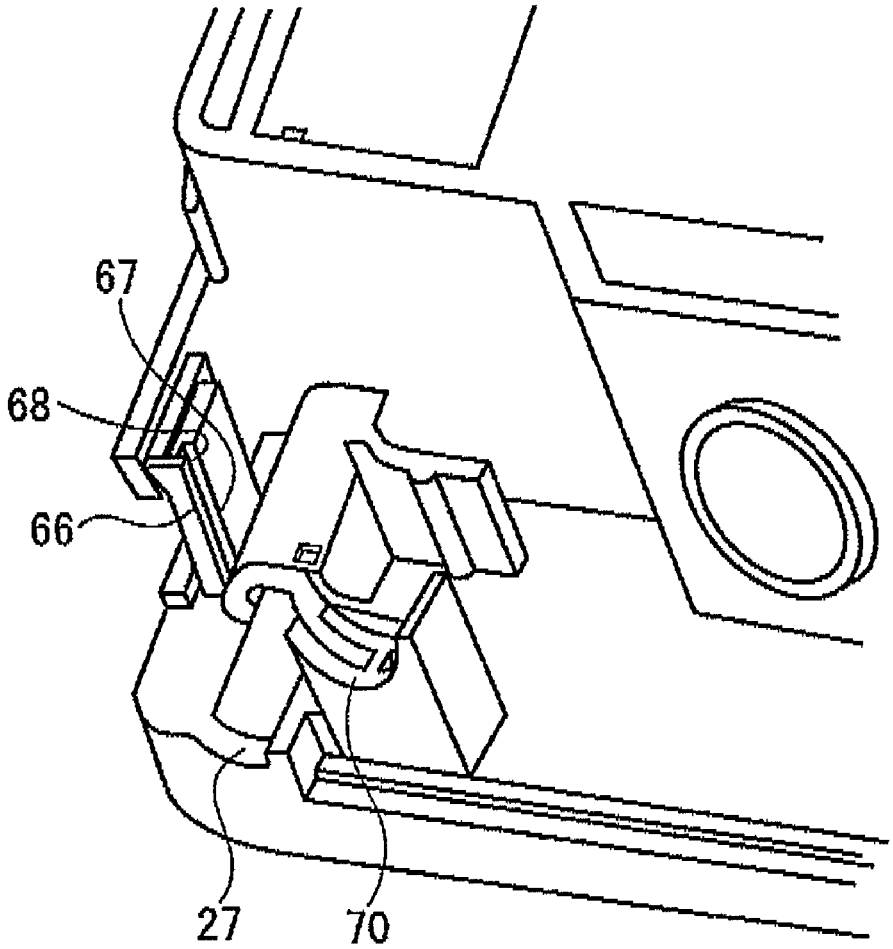
FIG. 11 is a perspective view illustrating a state where a part near a corner of a container body is broken away.

In addition, as shown in FIGS. 9B and 11, a pair of guide ribs 66 and 67 serving as position regulating member for causing the positions of the other ends of the relay terminals 43 and 44 to match the positions of the contact points 31*d* on the circuit board 31 are provided near the attachment position of the circuit board 31 on the container body 5 so as to protrude from the circuit board 31.

The pair of guide ribs 66 and 67 is formed with a groove 68 through which the other ends 43*b* and 44*b* can pass, and the positions of the other ends 43*b* and 44*b* are made to match the positions of the contact points 31*d* by gradually narrowing the groove width.

Figure 10:
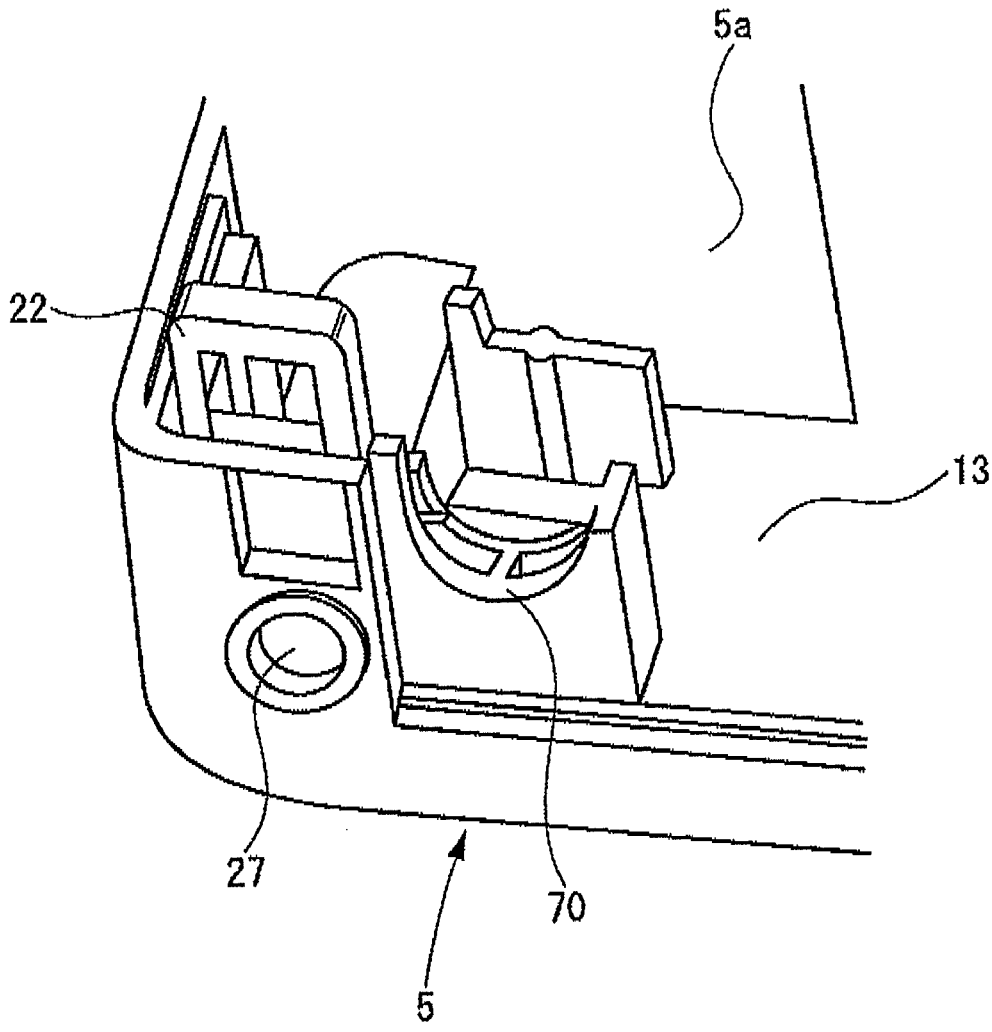
FIG. 10 is an enlarged perspective view illustrating the vicinity of a front-surface corner of a container body.

Furthermore, at the position slightly distant from the attachment position of the circuit board 31 on the container body 5 toward the attachment portion 23, a case holding portion 70, in which the outer periphery of the liquid lead-out portion 9 of the unit case 33 fits when the unit case 33 is rotated up to the position where the other ends 43*b* and 44*b* of the relay terminals 43 and 44 come in contact with the contact points 31*d*, is provided as shown in FIGS. 10 and 11.

Furthermore, in the present embodiment, an elastic member 71 that enables elastic displacement to the rotation axis when the remaining liquid amount detecting unit 11 is attached to the container body 5 is provided on each of the other ends 43*b* and 44*b* of the relay terminals 43 and 44.

In the present embodiment, the elastic member 71 is a bent portion formed when each of the relay terminals 43 and 44 is formed by press molding.

Moreover, in the present embodiment, a deep-drawing portion 73 for increasing the rigidity of a terminal is formed along the longitudinal direction of the terminal near each of the attaching holes 61 and 62 of the one ends 43*a* and 44*a* of the relay terminals 43 and 44.

The relay terminals 43 and 44 are formed by press molding using a metal plate, and the deep-drawing portion 73 is formed by pressing.

Furthermore, in the present embodiment, each of the relay terminals 43 and 44 has at least one elastic deformation allowing portion 75 in a middle part located between one end and the other end thereof.

In the present embodiment, the elastic deformation allowing portion 75 is a bent portion formed when each of the relay terminals 43 and 44 is formed by press molding.

In the present embodiment, the ink cartridge 1 is assembled in the following procedures.

First, as shown in FIG. 7, the remaining liquid amount detecting unit 11 is fitted to the attachment portion 23 of the container body 5 in a condition where the remaining liquid amount detecting unit 11 stands up vertically. Then, by rotating the remaining liquid amount detecting unit 11 that is fitted in the direction indicated by arrow I, an attaching-completed state where the other ends 43*b* and 44*b* of the relay terminals 43 and 44 protruding toward the other end side of the remaining liquid amount detecting unit 11 are brought into contact with the contact point 31*d* on a bottom surface of the circuit board 31 is obtained as shown in FIG. 12.

Then, the ink pack 7 is loaded into the pack accommodating section 3 of the container body 5, the connection port 7*a* is connected to the connection pin 11*a* of the remaining liquid amount detecting unit 11, and the spacer 19 is set on the inclined portions 7*c* and 7*d* of the ink pack 7, thereby obtaining a state shown in FIG. 13. Subsequently, the sealing film 15 is bonded to a top surface of the container body 5 by welding or the like so that the pack accommodating section 3 can be made as a sealed chamber and then the cover 21 is attached thereon, thereby completing assembly.

In the ink cartridge 1 described above, the remaining liquid amount detecting unit 11 is fixed to the container body 5 by fitting the remaining liquid amount detecting unit 11 to the attachment portion 23, which is present at the position distant from the circuit board 31 on the container body 5, and then rotating the remaining liquid amount detecting unit 11 around the attachment portion 23.

That is, since attachment of the remaining liquid amount detecting unit 11 to the container body 5 having the pack accommodating section 3 is completed by a simple operation of rotating the remaining liquid amount detecting unit 11, assembly efficiency is satisfactory. As a result, it is possible to improve the productivity of the ink cartridge 1 by the improvement in assembly efficiency.

In addition, since the one ends 43*a* and 44*a* of the relay terminals 43 and 44, which electrically connect the terminals 32*a* and 32*b* of the sensor member 32 on the remaining liquid amount detecting unit 11 to the contact points 31*d* on the circuit board 31, are positioned and fixed to the unit case 33 of the remaining liquid amount detecting unit 11 in a state where the one ends 43*a* and 44*a* of the relay terminals 43 and 44 come in contact with and are electrically connected to the terminals 32*a* and 32*b* of the sensor member 32, each of the relay terminals 43 and 44 is reliably connected to the terminal of the sensor member 32. Furthermore, the other ends of the relay terminals 43 and 44, which are movably supported on the unit case 33, are guided to the positions of the contact points 31*d* on the circuit board 31 so as to match the contact points 31*d* by means of the guide ribs 66 and 67 provided in the container body 5 to which the circuit board 31 is fixed. Accordingly, the other ends of the relay terminals 43 and 44 are also reliably connected to the contact points 31*d* of the circuit board 31 regardless of a dimensional tolerance or an assembly error.

Thus, the contact points 31*d* on the circuit board 31 provided in the container body 5 and the terminals 32*a* and 32*b* of the sensor member 32 on the remaining liquid amount detecting unit 11 can be reliably electrically connected to each other through the relay terminals 43 and 44 of the remaining liquid amount detecting unit 11 that is fitted to the container body 5 by a rotation operation.

Furthermore, in the present embodiment, the elastic member 71 that enables the elastic displacement to the rotation axis when the remaining liquid amount detecting unit 11 is attached to the container body 5 is provided on each of the other ends 43*b* and 44*b* of the relay terminals 43 and 44 which are brought into the contact points 31*d* on the circuit board 31. Therefore, positional deviation of the other ends 43*b* and 44*b* of the relay terminals 43 and 44 in the longitudinal direction thereof, which is caused by the dimensional tolerance or the assembly error, is absorbed by elastic displacement of the elastic member 71, and a variation in contact pressure between the other ends 43*b* and 44*b* of the relay terminals 43 and 44 and the contact points 31*d* on the circuit board 31 is suppressed. As a result, highly reliable electrical connection can be realized.

Furthermore, in the present embodiment, the elastic member 71 provided on each of the other ends 43*b* and 44*b* of the relay terminals 43 and 44 is a bent portion obtained by bending a part near the end at an acute angle. In such a configuration, the elastic member of the other ends may be formed only by a predetermined bending process, for example, in the case where the relay terminal is formed by press molding using a metal plate. In addition, the elastic member may be provided on the other ends without consumption of time and effort taken for addition, connection, and the like of a separate component.

In addition, a specific form of the elastic member 71 is not limited to the bent portion, which is bent at an acute angle, exemplified in the above embodiment. As the elastic member 71, one having an elastic force enough to absorb a dimensional tolerance or an assembly error may be used. For example, a molded portion having a bay shape or a curve shape may be provided as the elastic member 71.

Moreover, in the present embodiment, the deep-drawing portion 73 for increasing the rigidity of a terminal is formed along the longitudinal direction of the terminal near each of the attaching holes 61 and 62 of the one ends 43*a* and 44*a* of the relay terminals 43 and 44 fixed to the unit case 33. Since the rigidity of the one ends of the relay terminals 43 and 44 is increased due to the deep-drawing portion 73, it is possible to prevent the relay terminals 43 and 44 from deforming due to a load when fitting the attaching holes 61 and 62 of the one ends 43*a* and 44*a* of the relay terminals 43 and 44 in the bosses on the unit case 33 by pressure. In addition, it is possible to prevent the positioning accuracy of the ends of the relay terminals 43 and 44 from decreasing due to deformation caused by the load at the time of attachment.

Furthermore, in the present embodiment, each of the relay terminals 43 and 44 has the elastic deformation allowing portion 75 even in the middle part located between each of the one ends 43*a* and 44*a* and each of the other ends 43*b* and 44*b*. Therefore, the positional deviation caused by the dimensional tolerance or the assembly error can be absorbed not only by the elastic member 71 provided on the other ends 43*b* and 44*b* of the relay terminals 43 and 44 but also by the elastic deformation allowing portion 75 provided in the middle part. As a result, the reliability of electrical connection made between the sensor member 32 and the circuit board 31 through the relay terminals 43 and 44 can be further improved.

Furthermore, in the present embodiment, the elastic deformation allowing portion 75 provided in the middle part of each of the relay terminals 43 and 44 is a bent portion formed when the relay terminals 43 and 44 are formed by press molding, and can be provided without consumption of time and effort taken for addition, connection, and the like of a separate component in the same manner as the elastic member 71 provided on the other ends 43*b* and 44*b* of the relay terminals 43 and 44.

In addition, a specific form of the elastic deformation allowing portion 75 is not limited to the approximately right-angled bent portion exemplified in the above embodiment. In the same manner as the elastic member 71, one having an elastic force enough to absorb a dimensional tolerance or an assembly error may be used as the elastic deformation allowing portion 75. For example, a molded portion having a bay shape or a curve shape may be provided as the elastic deformation allowing portion 75.

In addition, although only one elastic deformation allowing portion 75 has been formed in the middle part of each of the relay terminals 43 and 44 in the above-described embodiment, the elastic deformation allowing portion 75 that can be formed by press molding described above may be formed in a plural number.

In addition, in the above embodiment, an attachment structure using a rotation operation has been illustrated as the structure of attaching the remaining liquid amount detecting unit 11 to the container body 5. However, the structure of attaching the remaining liquid amount detecting unit 11 to the container body 5 is not limited to the above-described embodiment as long as an attaching operation is simple. For example, a structure in which the remaining liquid amount detecting unit is attached to the container body in an up and down sliding operation may also be considered.

In addition, application of the liquid container of the invention is not limited to the ink cartridge of an ink jet recording apparatus. The liquid container of the invention may be used for various kinds of liquid consuming apparatuses each having a liquid ejecting head.

For example, specific examples of the liquid consuming apparatus having a liquid ejecting head include an apparatus provided with a color material ejecting head used to manufacture a color filter for a liquid crystal display or the like, an apparatus provided with an electrode material (conductive paste) ejecting head used to form an electrode of an organic EL display, a surface emission display (FED), or the like, an apparatus provided with a bioorganic material ejecting head used to manufacture a biochip, an apparatus provided with a sample ejecting head as a precision pipette, a textile printing apparatus, a microdispenser, and the like.

This application claims priority from Japanese Patent Application No 2006-350224 filed on Dec. 26, 2006, the entire disclosure of which is expressly incorporated by reference herein.

While this intention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the sprit and scope of the invention.

What is claimed is:

1. A liquid container comprising:

a container body which has a liquid containing portion for containing liquid therein and which is detachably mounted in a container mounting portion of a liquid consuming apparatus;

a remaining liquid amount detecting unit in which a sensor member for detecting a state of a remaining liquid amount is provided in a unit case and which is detachably attached to the container body;

a circuit board which has a memory device and a contact point for connecting the memory device to a connection terminal of the container mounting portion and which is attached to the container body; and a relay terminal which is attached to the unit case so as to electrically connect the sensor member to the circuit board, wherein the remaining liquid amount detecting unit is attached to an attachment portion, which is provided at a position spaced apart from the circuit board on the container body, by a predetermined operation, the relay terminal is fixed to the unit case in a state where one end thereof comes in contact with and is electrically connected to a terminal of the sensor member, and the other end of the relay terminal is movably held on the unit case, a position regulating member for causing a position of the other end of the relay terminal to match a position of the contact point on the circuit board is provided near an attachment position of the circuit board so as to protrude from the attachment position, and the predetermined operation is fitting the remaining liquid amount detecting unit to the attachment portion on the container body and then rotating the remaining liquid amount detecting unit.

2. The liquid container according to claim 1, wherein the other end of the relay terminal is held on the unit case so as to be movable in a rotation-axis direction when the remaining liquid amount detecting unit is attached to the container body.

3. The liquid container according to claim 2, wherein an elastic member for enabling elastic displacement to a side of a rotation axis of when the remaining liquid amount detecting unit is attached to the container body is provided on the other end of the relay terminal that is brought into contact with the contact point on the circuit board.

4. The liquid container according to claim 3, wherein the elastic member provided on the other end of the relay terminal is a bent portion.

5. The liquid container according to claim 4, wherein a portion that increases a rigidity of the terminal is formed along a longitudinal direction of the terminal near an attaching hole of the one end of the relay terminal that is fixed to the unit case, the attaching hole being used for attaching the relay terminal to the unit case.

6. The liquid container according to claim 4, wherein the relay terminal has at least one elastic deformation allowing portion in a middle part thereof located between the one end and the other end.

7. The liquid container according to claim 3, wherein a portion that increases a rigidity of the terminal is formed along a longitudinal direction of the terminal near an attaching hole of the one end of the relay terminal that is fixed to the unit case, the attaching hole being used for attaching the relay terminal to the unit case.

8. The liquid container according to claim 3, wherein the relay terminal has at least one elastic deformation allowing portion in a middle part thereof located between the one end and the other end.

9. The liquid container according to claim 2, wherein a portion that increases a rigidity of the terminal is formed along a longitudinal direction of the terminal near an attaching hole of the one end of the relay terminal that is fixed to the unit case, the attaching hole being used for attaching the relay terminal to the unit case.

10. The liquid container according to claim 2, wherein the relay terminal has at least one elastic deformation allowing portion in a middle part thereof located between the one end and the other end.

11. The liquid container according to claim 1, wherein a portion that increases a rigidity of the terminal is formed along a longitudinal direction of the terminal near an attaching hole of the one end of the relay terminal that is fixed to the unit case, the attaching hole being used for attaching the relay terminal to the unit case.

12. The liquid container according to claim 11, wherein the relay terminal has at least one elastic deformation allowing portion in a middle part thereof located between the one end and the other end.

13. The liquid container according to claim 1, wherein the relay terminal has at least one elastic deformation allowing portion in a middle part thereof located between the one end and the other end.

14. A liquid container detachably mounted on a liquid consuming apparatus, comprising:

a front face in which a liquid lead-out portion is provided and a side face intersecting the front face;

a liquid containing portion for containing liquid therein;

a unit case attached to the liquid container and including a sensor member for detecting a remaining liquid amount of the liquid containing portion;

a circuit board that is provided at the side face and having a first contact point provided on a first face for connecting to the liquid consuming apparatus and a second contact point provided on a second face opposite to the first face;

a relay terminal attached to the unit case, a first end of the relay terminal connecting the sensor member and a second end connecting the second contact point provided on the second face of the circuit board; and a guide member having a slit for guiding the second end of the relay terminal to the second contact point, wherein the unit case is attached to an attachment portion of a container body of the liquid container by a predetermined operation, and the predetermined operation is fitting the unit case to the attachment portion on the container body and then rotating the unit case.

15. The liquid container according to claim 14, wherein a width of the slit is narrowed as the slit becomes deeper.

* * * * *